US010987538B2

(12) United States Patent
Fowler

(10) Patent No.: US 10,987,538 B2
(45) Date of Patent: Apr. 27, 2021

(54) MODULAR SPACE-SAVING EXERCISE EQUIPMENT

(71) Applicant: David Alexander Fowler, Nottingham (GB)

(72) Inventor: David Alexander Fowler, Nottingham (GB)

( * ) Notice: Subject to any disclaimer, the term of this patent is extended or adjusted under 35 U.S.C. 154(b) by 25 days.

(21) Appl. No.: 15/922,315

(22) Filed: Mar. 15, 2018

(65) Prior Publication Data

US 2018/0264311 A1 Sep. 20, 2018

(30) Foreign Application Priority Data

Mar. 15, 2017 (GB) ..... 1704112

(51) Int. Cl.
*A63B 21/16* (2006.01)
*A63B 21/00* (2006.01)
(Continued)

(52) U.S. Cl.
CPC ..... *A63B 21/169* (2015.10); *A63B 21/02* (2013.01); *A63B 21/0628* (2015.10);
(Continued)

(58) Field of Classification Search
CPC ..... A63B 21/169; A63B 21/4035; A63B 21/4043; A63B 21/02; A63B 21/154;
(Continued)

(56) References Cited

U.S. PATENT DOCUMENTS 332,989 A 12/1885 Benedict
475,400 A 5/1892 Houghton et al.
(Continued)

FOREIGN PATENT DOCUMENTS

EP 1790389 11/2006
FR 2480608 4/1980
(Continued)

OTHER PUBLICATIONS

UKIPO Search Report dated Sep. 1, 2017; 4 pages.
EPO Communication for European Application 16706408.8 dated Sep. 24, 2019 (7 pages).

*Primary Examiner* — Nyca T Nguyen
*Assistant Examiner* — Andrew M Kobylarz
(74) *Attorney, Agent, or Firm* — Bond, Schoeneck & King, PLLC; Joseph Noto

(57) ABSTRACT

The invention concerns a modular exercise system having a first support frame module having a plurality of frame members, each member being joined to an adjacent frame member and oriented in a common plane such that the first support frame is two-dimensional in form. The modular exercise system further requires a weight source mounted on the first support frame, a plurality of pulleys mounted to different frame members of the first support frame, and a cable running from the weight source over the pulleys to connect the weight source to one or more manual actuator for performing a resistance exercise in use. The first support frame has one or more attachment formation for selective attachment to one or more further support frame module. The further support frame module is also two-dimensional in form and attachable to the first support frame in an orientation within the common plane, wherein the further support frame module has one or more further manual actuator.

15 Claims, 8 Drawing Sheets

(51) Int. Cl.

| | |
|---|---|
| ***A63B 23/035*** | (2006.01) |
| ***A63B 21/02*** | (2006.01) |
| ***A63B 21/062*** | (2006.01) |
| ***A63B 22/00*** | (2006.01) |
| ***A63B 71/04*** | (2006.01) |
| ***A63B 71/02*** | (2006.01) |

(52) U.S. Cl.

CPC ..... *A63B 21/154* (2013.01); *A63B 21/156* (2013.01); *A63B 21/4035* (2015.10); *A63B 21/4043* (2015.10); *A63B 22/0076* (2013.01); *A63B 23/0355* (2013.01); *A63B 23/03525* (2013.01); *A63B 23/03566* (2013.01); *A63B 71/04* (2013.01); *A63B 22/0048* (2013.01); *A63B 22/0087* (2013.01); *A63B 2022/0079* (2013.01); *A63B 2071/024* (2013.01); *A63B 2210/06* (2013.01); *A63B 2210/50* (2013.01); *A63B 2225/10* (2013.01); *A63B 2225/102* (2013.01); *A63B 2225/105* (2013.01); *A63B 2225/107* (2013.01)

(58) Field of Classification Search

CPC ..... A63B 21/03525; A63B 21/0628; A63B 21/156; A63B 22/0076; A63B 23/03566; A63B 71/04; A63B 22/0048; A63B 22/0087; A63B 2022/0079; A63B 2071/024; A63B 2210/06; A63B 2210/50; A63B 2225/102; A63B 2225/105; A63B 2225/107

See application file for complete search history.

(56) References Cited

U.S. PATENT DOCUMENTS

| | | | | |
|---|---|---|---|---|
| 4,257,590 | A | 3/1981 | Sullivan et al. | |
| 4,898,381 | A | 2/1990 | Gordon | |
| 4,976,428 | A | 12/1990 | Ghazi | |
| 5,267,930 | A | 12/1993 | Henes | |
| 6,626,801 | B2 * | 9/2003 | Marques | A63B 17/00 482/23 |
| 7,575,538 | B1 * | 8/2009 | Clark | A63B 21/154 482/103 |
| 7,837,602 | B1 | 11/2010 | Drybread | |
| 9,776,036 | B1 * | 10/2017 | Nieves | A63B 21/154 |
| 2006/0160680 | A1 * | 7/2006 | Ripley | A63B 21/0552 482/121 |
| 2006/0264305 | A1 * | 11/2006 | Klassen | A63B 21/4019 482/99 |
| 2008/0015095 | A1 | 1/2008 | Savsek et al. | |
| 2009/0181833 | A1 | 7/2009 | Cassidy et al. | |
| 2011/0237405 | A1 | 9/2011 | Reyes | |
| 2017/0056705 | A1 | 3/2017 | Zha et al. | |
| 2017/0246507 | A1 * | 8/2017 | Kennington | A63B 23/1209 |

FOREIGN PATENT DOCUMENTS

| | | |
|---|---|---|
| GB | 307116 | 3/1928 |
| GB | 2268086 | 5/1994 |
| WO | 2008/050330 | 5/2008 |
| WO | 2009/003280 | 1/2009 |
| WO | 2015/196158 | 12/2015 |
| WO | 2016/132132 | 8/2016 |

* cited by examiner

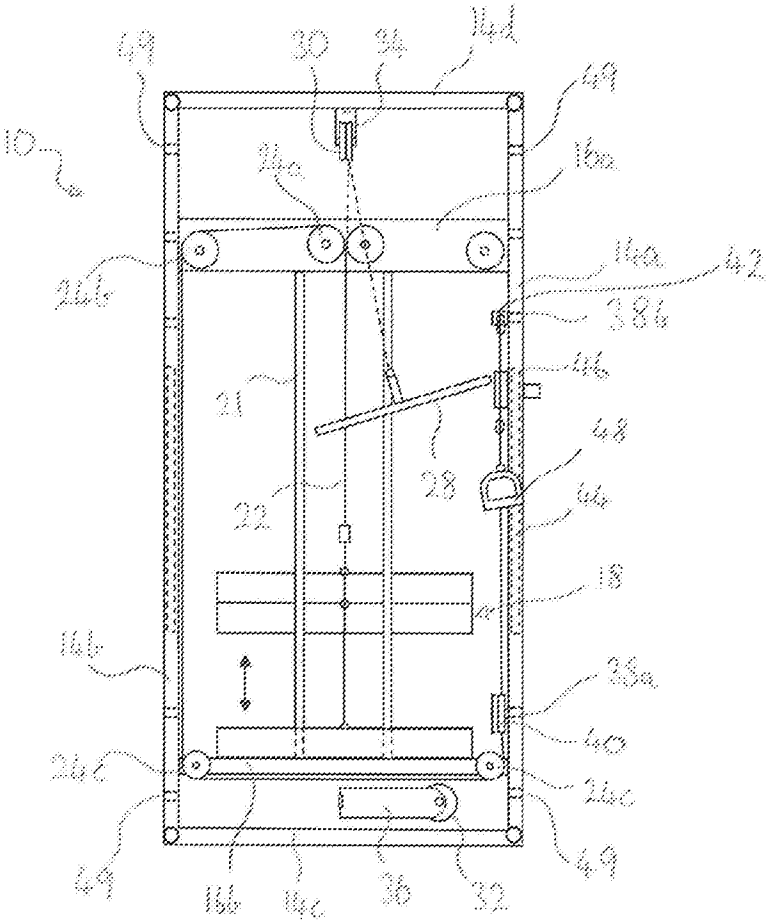
10
14d
14a
14b
14c
14e
14f
14g
14h
14i
14j
14k
14l
14m
14n
14o
14p
14q
14r
14s
14t
14u
14v
14w
14x
14y
14z
14aa
14ab
14ac
14ad
14ae
14af
14ag
14ah
14ai
14aj
14ak
14al
14am
14an
14ao
14ap
14aq
14ar
14as
14at
14au
14av
14aw
14ax
14ay
14az
14ba
14bb
14bc
14bd
14be
14bf
14bg
14bh
14bi
14bj
14bk
14bl
14bm
14bn
14bo
14bp
14bq
14br
14bs
14bt
14bu
14bv
14bw
14bx
14by
14bz
14ca
14cb
14cc
14cd
14ce
14cf
14cg
14ch
14ci
14cj
14ck
14cl
14cm
14cn
14co
14cp
14cq
14cr
14cs
14ct
14cu
14cv
14cw
14cx
14cy
14cz
14da
14db
14dc
14dd
14de
14df
14dg
14dh
14di
14dj
14dk
14dl
14dm
14dn
14do
14dp
14dq
14dr
14ds
14dt
14du
14dv
14dw
14dx
14dy
14dz
14ea
14eb
14ec
14ed
14ee
14ef
14eg
14eh
14ei
14ej
14ek
14el
14em
14en
14eo
14ep
14eq
14er
14es
14et
14eu
14ev
14ew
14ex
14ey
14ez
14fa
14fb
14fc
14fd
14fe
14ff
14fg
14fh
14fi
14fj
14fk
14fl
14fm
14fn
14fo
14fp
14fq
14fr
14fs
14ft
14fu
14fv
14fw
14fx
14fy
14fz
14ga
14gb
14gc
14gd
14ge
14gf
14gg
14gh
14gi
14gj
14gk
14gl
14gm
14gn
14go
14gp
14gq
14gr
14gs
14gt
14gu
14gv
14gw
14gx
14gy
14gz
14ha
14hb
14hc
14hd
14he
14hf
14hg
14hh
14hi
14hj
14hk
14hl
14hm
14hn
14ho
14hp
14hq
14hr
14hs
14ht
14hu
14hv
14hw
14hx
14hy
14hz
14ia
14ib
14ic
14id
14ie
14if
14ig
14ih
14ii
14ij
14ik
14il
14im
14in
14io
14ip
14iq
14ir
14is
14it
14iu
14iv
14iw
14ix
14iy
14iz
14ja
14jb
14jc
14jd
14je
14jf
14jg
14jh
14ji
14jj
14jk
14jl
14jm
14jn
14jo
14jp
14jq
14jr
14js
14jt
14ju
14jv
14jw
14jx
14jy
14jz
14ka
14kb
14kc
14kd
14ke
14kf
14kg
14kh
14ki
14kj
14kk
14kl
14km
14kn
14ko
14kp
14kq
14kr
14ks
14kt
14ku
14kv
14kw
14kx
14ky
14kz
14la
14lb
14lc
14ld
14le
14lf
14lg
14lh
14li
14lj
14lk
14ll
14lm
14ln
14lo
14lp
14lq
14lr
14ls
14lt
14lu
14lv
14lw
14lx
14ly
14lz
14ma
14mb
14mc
14md
14me
14mf
14mg
14mh
14mi
14mj
14mk
14ml
14mm
14mn
14mo
14mp
14mq
14mr
14ms
14mt
14mu
14mv
14mw
14mx
14my
14mz
14na
14nb
14nc
14nd
14ne
14nf
14ng
14nh
14ni
14nj
14nk
14nl
14nm
14nn
14no
14np
14nq
14nr
14ns
14nt
14nu
14nv
14nw
14nx
14ny
14nz
14oa
14ob
14oc
14od
14oe
14of
14og
14oh
14oi
14oj
14ok
14ol
14om
14on
14oo
14op
14oq
14or
14os
14ot
14ou
14ov
14ow
14ox
14oy
14oz
14pa
14pb
14pc
14pd
14pe
14pf
14pg
14ph
14pi
14pj
14pk
14pl
14pm
14pn
14po
14pp
14pq
14pr
14ps
14pt
14pu
14pv
14pw
14px
14py
14pz
14qa
14qb
14qc
14qd
14qe
14qf
14qg
14qh
14qi
14qj
14qk
14ql
14qm
14qn
14qo
14qp
14qq
14qr
14qs
14qt
14qu
14qv
14qw
14qx
14qy
14qz
14ra
14rb
14rc
14rd
14re
14rf
14rg
14rh
14ri
14rj
14rk
14rl
14rm
14rn
14ro
14rp
14rq
14rr
14rs
14rt
14ru
14rv
14rw
14rx
14ry
14rz
14sa
14sb
14sc
14sd
14se
14sf
14sg
14sh
14si
14sj
14sk
14sl
14sm
14sn
14so
14sp
14sq
14sr
14ss
14st
14su
14sv
14sw
14sx
14sy
14sz
14ta
14tb
14tc
14td
14te
14tf
14tg
14th
14ti
14tj
14tk
14tl
14tm
14tn
14to
14tp
14tq
14tr
14ts
14tt
14tu
14tv
14tw
14tx
14ty
14tz
14ua
14ub
14uc
14ud
14ue
14uf
14ug
14uh
14ui
14uj
14uk
14ul
14um
14un
14uo
14up
14uq
14ur
14us
14ut
14uv
14uw
14ux
14uy
14uz
14va
14vb
14vc
14vd
14ve
14vf
14vg
14vh
14vi
14vj
14vk
14vl
14vm
14vn
14vo
14vp
14vq
14vr
14vs
14vt
14vu
14vv
14vw
14vx
14vy
14vz
14wa
14wb
14wc
14wd
14we
14wf
14wg
14wh
14wi
14wj
14wk
14wl
14wm
14wn
14wo
14wp
14wq
14wr
14ws
14wt
14wu
14wv
14ww
14wx
14wy
14wz
14xa
14xb
14xc
14xd
14xe
14xf
14xg
14xh
14xi
14xj
14xk
14xl
14xm
14xn
14xo
14xp
14xq
14xr
14xs
14xt
14xu
14xv
14xw
14xx
14xy
14xz
14ya
14yb
14yc
14yd
14ye
14yf
14yg
14yh
14yi
14yj
14yk
14yl
14ym
14yn
14yo
14yp
14yq
14yr
14ys
14yt
14yu
14yv
14yw
14yx
14yy
14yz
14za
14zb
14zc
14zd
14ze
14zf
14zg
14zh
14zi
14zj
14zk
14zl
14zm
14zn
14zo
14zp
14zq
14zr
14zs
14zt
14zu
14zv
14zw
14zx
14zy
14zz

MODULAR SPACE-SAVING EXERCISE EQUIPMENT

CROSS REFERENCE TO RELATED APPLICATION

This application is a United States Non-Provisional Utility application, which claims priority to Great Britain Application Serial Number GB1704112.0, filed Mar. 15, 2017, the disclosure of which is incorporated herein in its entirety.

BACKGROUND

The present invention relates to exercise equipment, and in particular to home exercise equipment, such as, for example, resistance weight machines.

Many people take part in weight training or aerobic exercise in order to improve fitness, increase strength and improve muscle tone. People may choose to exercise at a public gym or health club, or alternatively may choose to install gym equipment within their own property. Owning home gym equipment may be preferable for many people as it provides the user with the convenience of exercising at home, thereby avoiding the cost, travel and social implications of exercising at a communal gym.

A disadvantage associated with conventional home gym equipment is its size. For example, a bench press, a rowing machine or a chest press require a large amount of floor space. In order for a personal home gym to comprise a sufficient variety of equipment, it is often required that an entire room in a person's house is dedicated to being a home gym. Even then, the average garage or spare room within a typical home is often not large enough to safely house a wide variety of exercise machines.

The space available to accommodate exercise equipment in different dwellings can vary considerably.

In an attempt to overcome the problem of the large amount of room and floor space required for a home gym comprising a large variety of gym equipment, so-called multi-gyms have become well known in the prior art. Multi-gyms generally provide a variety of weight resistance apparatus in one single machine. However, multi-gyms themselves are large and generally take up a significant amount of floor space and room, typically approximately two to three cubic metres or more. This is at least in part due to the need for a multi-gym to accommodate a weight stack safely, thereby requiring a frame with sufficient spacing between its feet so as to be stable. The spacing between the feet causes conventional multi-gyms to have a large footprint, thereby eating into the available floor space within a room.

Multi-gyms are commonly designed for a user to move around different pieces of equipment in a circle or circuit, performing different exercises at the different pieces of equipment. This results in unused space at various locations around a multigym to accommodate a user located at each station, thereby demanding greater available floor space in a typical rectangular room with planar walls.

If a multi-gym is intended to accommodate various seated or reclining exercise positions, then this typically incurs a significant spatial penalty.

There is an increasing trend in the use of so-called garden rooms as exercise/workout spaces. Garden rooms typically comprise freestanding, e.g. timber frame, structures, separate from a main dwelling. Whilst such spaces are well suited to home gym equipment, the use of conventional multigyms detracts from any potential alternative uses of the space.

The applicant's co-pending international patent application PCT/GB2016/050402 (PCT publication WO 2016/132132) discloses multipurpose exercise equipment mounted to a frame with a particularly small depth, such that it can be installed in a recess, wall cavity or the like, without consuming significant floor space.

It is an object of the present invention to provide exercise or resistance weight training equipment offering a relatively small form factor, whilst providing the opportunity to customise the equipment to suit a variety of different exercises and/or installation constraints.

According to a first aspect of the invention there is provided a modular exercise system comprising: a first support frame module having a plurality of frame members, each member being joined to an adjacent frame member and oriented in a common plane such that the first support frame is two-dimensional in form; a weight source mounted on the first support frame; a plurality of pulleys mounted to different frame members of the first support frame; and a cable running from the weight source over the pulleys to connect the weight source to one or more manual actuator for performing a resistance exercise in use; the first support frame comprising one or more attachment formation for selective attachment to one or more further support frame module, the further support frame module also being two-dimensional in form and attachable to the first support frame in an orientation within the common plane, wherein the further support frame module comprises one or more further manual actuator.

The one or more further support frame module may comprise second and third support frame modules, each being two dimensional in form. One of the further support frame modules may be attachable on one side of the first support frame. Another of the further support frame modules may be attachable on an opposing side of the first support frame.

The first support frame may comprise an upright frame member on opposing lateral sides thereof. The weight source and/or pulley(s) may be located between the upright frame members.

Either or both upright frame member may comprise at least one attachment formation.

The first and further support frame may be attached together such that an upright frame member of the first support frame is adjacent to and/or parallel with an adjoining upright frame member of the further support frame. The first and further support frames may be substantially vertically oriented in use.

The first support frame module may comprise one or more fixing points for fixing the first support frame in an upright orientation to a support structure, such as a wall or other upright/vertical support structure. The fixing points may comprise a foot, pedestal, bracket or the like. The, or each, further support frame module may comprise one or more fixing points for fixing the further support frame in an upright orientation to the support structure, e.g. a common support structure with the first support frame. The, or each, support frame may be attached to the support structure by one or more fasteners, such as bolts or the like.

The first support frame module may be useable as exercise equipment in its own right, e.g. offering a limited number of exercise options and/or manual actuator configurations based on the cable and pulley system within the first support frame module structure. Thus the first support frame module can offer exercise equipment for fitment within a relatively confined space. However the modular nature of the system allows a second and, optionally, third support frame module to be attached thereto where the available area for mounting the exercise system is larger.

The one or more further support frame modules may comprise at least one further pulley. The one or more further support frame modules may comprise a plurality of further pulleys, and the pulleys of the first and further support frames may be oriented in a common plane with the frame members of the first and/or further support frames. The cable may be a common cable, e.g. a common length of cable, arranged to pass around the pulleys of the first and further support frame modules, e.g. so as to define a common cable and pulley system or common cable circuit. The cable may extend around a first pulley wheel towards a second and/or subsequent pulley wheels so as to define a cable circuit, e.g. an open-ended circuit, defining a force path from the weight stack to an opposing end of the cable. The pulleys may comprise one or more cable guide.

The first and/or further support frames may comprise one or more cable opening, e.g. to allow the cable to pass through a frame member such as an upstanding frame member. The cable may pass to the exterior of the frame member or else from one support frame into an adjoining/adjacent support frame of the system via the cable opening.

The cable may follow a path over at least a first pulley of the first support frame, followed by one or more further pulley of the further support frame module and subsequently a second pulley of the first support frame. If second and third support frame modules are used, the cable may pass from the first frame module over pulleys of the second and third support frame modules, e.g. before terminating at the first frame module.

The cable may terminate at the first support frame module, e.g. at or adjacent a pulley of the first support frame or at a connector on the first support frame. The cable may terminate at an actuator, e.g. a manual actuator, of the first support frame module.

The first and/or further support frame may comprise a plurality of pulley mounting points, and the pulleys may be removably receivable on the pulley mounting points so as to define a selectively reconfigurable pulley array and/or cable path.

The, or each, further support frame module may have a plurality of frame members, each member being joined to an adjacent frame member and oriented in a common plane.

The pulley wheels of the first and/or further support frames may be oriented in a common plane with the weight source and the frame members of the first and/or further support frames, in either or both of a storage and usage configuration of the exercise system.

The manual actuators may be connected at fixed spaced locations along the path defined by the cable length and may be actuatable in a direction away from the common plane when in use. The weight source may thus be actuated by the cable and pulley system in a direction within the common plane during use, e.g. within a vertical plane. This, in combination with the support by a support structure, allows the exercise apparatus to be accommodated in a very small depth, such that it can stand flat against, or parallel with, the support structure.

The first and/or further support frame may comprise a plurality of angled frame members, e.g. perpendicular frame members. The plurality of frame members may be rigidly/permanently affixed within the planar alignment. The entire exercise system comprising the first and further support frame modules be aligned with the common plane, e.g. at least in a storage condition.

The exercise system including the first and further support frame modules, and their respective components, may be beneficially thin in profile, e.g. having a depth dimension of less than 500 mm. The depth may be less than 400 mm, 300 mm or even less than 200 mm, e.g. in the region of, or less than, 150 mm or 100 mm. A range of 50-200 mm depth or 80-100 mm is entirely practical using the present invention. Thus the distance by which the exercise system protrudes into a room, at least when not in use, from a suitable supporting structure, such as a wall, is beneficially small.

The first and/or further support frame may comprise a cover, which may be planar in form. The cover may be attachable or attached to the frame. The cover may be releasably attached to the frame, for example by a latch, clip or one or more magnets. Magnets in the cover may be aligned with metal frame members or metal portions of the frame members. The cover may be held flat against the frame module in a storage condition by magnets.

The cover may be laid flat when the first and/or further support frame is in use to provide a mat, e.g. a floor mat. The cover may be pivotably attached to the frame, e.g. a base of the frame. Additionally or alternatively, the cover may be releasably attachable to a base portion of the frame.

The cover may comprise a rigid backing and a softer cover layer, e.g. of a textile or foam or other resiliently deformable material.

Each of the first and further support frames may have an individual cover, or a common cover may be provided for the combined first and further support frames. If a plurality of covers are provided, each cover may be attachable, e.g. releasably to an adjacent cover in a coplanar configuration.

A common/single weight source of the first support frame module may be provided to accommodate the further support frame module. The cable and pulley system may thus be common to both/all modules. The manual actuator(s) of the further support frame module(s) may act on the common cable and weight source of the first support frame module.

A plurality of types of manual actuator may be provided. The manual actuators may comprise any or any combination of a pull bar, having two spaced handle/grip portions on a common bar, a handle, a stirrup, a loop or a two spaced handle/grip portions coupled to a common location on the cable. A linear actuator or a pivoting/rotating actuator, such as a lever, could be provided. One manual actuator may comprise a rowing action actuator. One manual actuator may comprise a pulldown bar or T-bar.

Each actuator may be individually or collectively connected to the weight source, e.g. in series or parallel. A plurality of manual actuators may be connected at differing lengths/locations along the cable, e.g. at different cable length spacing from the weight source. Different/adjacent manual actuators may be spaced by one or more pulley wheel. This may allow each manual actuator to apply tension to the cable in a different direction or orientation or at a different height from one or more further manual actuator.

Each module may comprise a plurality of manual actuators or manual actuator types.

The manual actuators may be releasably connectable to the cable at various connection locations along the length of the cable. Multiple actuators may be attachable to a single/common cable of the exercise system. The manual actuators may be releasably connectable to the cable, e.g. in order that a user may selectively add/remove actuators or change the position of the actuators on the cable.

The further manual actuator may not be connected to the cable. Where the further manual actuator is not connected to the cable, the further support frame may comprise a resistance mechanism arranged to resist motion of the manual actuator in use.

The cable may comprise a plurality of manual actuator connection locations or formations along its length. The connection formations may or may not comprise any of eyes, links, clips, loops or the like. The connection locations may allow bifurcation of the cable, i.e. a common cable section connecting to the weight source, for example by providing one or more junction to a branching cable section.

One or more swivel connector may be provided in the cable. The swivel connector may comprise adjacent eye formations connected by a swivel pin. The one or more swivel connector may be provided part-way along the cable length, e.g. with one cable section depending from one eye formation and an adjacent cable section depending from the other eye formation so as to a single elongate cable having connected adjoining sections. The one or more swivel connector may provide the connection location for a manual actuator. The swivel connector may prevent twisting of the cable, e.g. part-way along the cable length. Adjacent cable sections may be connected by swivel connectors at locations between adjacent pulley wheels. A swivel connector may be provided at the junction between the common cable and one or more branch sections.

Any, any combination, or all of the manual actuators of the first and/or further support frame modules may be directly/indirectly attached to a fixed point on the cable.

Any, any combination, or all of the manual actuators may be connected to a branching cable section, e.g. midway along its length or at an end thereof. A branching cable section may be connected to the common cable section at one end and to any of a manual actuator, a location on the first/further support frame or a hanging counterweight at an opposing end.

The cable may comprise or consist of a cord. The cable may comprise or consist of a chain.

The/each pulley typically comprises a wheel mounted to a bracket via an axle and/or bearings.

A first end of the cable may be attached to the weight source. An opposing end of the cable may be attached to a manual actuator.

A plurality of the pulley wheel(s) may have an axis of rotation this is substantially perpendicular to the common plane of the first and/or further support frame module. A pulley wheel that is adjacent a manual actuator, e.g. at the cable end, may be angularly offset from one or more further pulley wheel in use.

The at least one pulley wheel may be pivotable about an axis that is in the common plane, e.g. in order that the pulley wheel may rotate out of the common plane for use. One or more pulley may be mounted to the support frame by a pivotable/hinged bracket or arm.

There may be provided cable guides on the first and/or further support frame, for example rollers, hooks or eyes which may extend at least partially around the cable. The cable guides may provide a location around which the cable may bend when a user pulls on an actuator, thereby providing the location from which the cable, e.g. a common or branching portion thereof, is pulled out of the common plane of the first/further support frame. The position of the guides relative to the support frame may be variable, in order that a user may pull the cable from different locations on the support frame. The guides may be selectively repositionable along a frame member. Additionally or alternatively, the cable guides may serve to maintain the correct orientation of the cable within the common plane, e.g. adjacent a pulley wheel or part/mid way between spaced pulley wheels.

In use, a user may pull one or more manual actuator in a direction that is in the common plane or out of the common plane.

The exercise system may comprise one or more counterweight attached to the cable. A counter weight may be located within the first and/or further support frame, e.g. within the common plane. The first and/or further support frame may comprise a counterweight guide or guard, which may be hollow so as to enclose/constrain the counterweight. The counterweight guide may comprise an elongate tube, e.g. within which the counterweight can rise and fall in use. The counterweight may serve to maintain a desired tension in the cable. The counterweight may be suspended on the cable by a further pulley, and the counterweight and the further pulley may be located in the further support frame.

The first or further frame module may comprise a bench or seat, e.g. mounted to one or more frame member thereof. The seat may be pivotably mounted to the first/further support frame, e.g. such that the seat can pivot between a storage condition in which the seat is aligned with the common plane and a usage condition in which the seat is angularly oriented, e.g. substantially perpendicular, relative to the common plane. The seat may be a sliding seat, for example the seat of a rowing machine. The seat may be fixed or lockable and may be for the user to sit when undertaking certain weight exercises. The seat may comprise one or more leg, e.g. a foldable leg, to support the seat on/above the ground when in use. The seat may comprise a beam on which the seat is supported relative to the leg.

The, or each, further support frame may comprise further exercise apparatus that may be attached to the support frame. For example, the manual actuator of the further support frame may comprise a stepper/treadle that may fold out of the frame. The further exercise apparatus that may not form part of the cable/pulley system and may comprise a separate weight or resistance source.

The first or further support frame module may comprise a manual actuator in the form of a lever arm, e.g. a pair of lever arms. The one or more lever may be pivotally mounted to the support frame, e.g. to a lower frame member or base of the relevant support frame. The pivotal mounting may allow actuation of the lever arm for manual exercise in use and/or pivoting of the lever arm(s) between storage and usage conditions. In the storage condition, the lever arm(s) may extend in a direction within the common plane, e.g. within the perimeter of the support frame. In a usage condition, the lever arm(s) may extend away from the common plane.

The pair of lever arms may be connected by a coupling at a location along the lever arm spaced from the pivotal mounting with the support frame. The coupling may comprise a flexible elongate member, such as a chain, strap, cord or a further cable. The coupling may be held in tension between the lever arms by an intermediate coupling guide, which may be mounted above the lever arms on the support frame. The guide may or may not comprise a gear wheel. The guide may comprise friction mechanism for resisting free movement of the coupling, such as a friction block, roller, brake or the like. The resistance may be user adjustable.

The one or more lever may comprise a foot plate, e.g. at a distance spaced from the pivoting connection with the support frame and/or towards a free end of the lever arm.

The exercise equipment may be embedded/mounted within the surface of a wall or affixed against an interior or exterior wall surface of a building. The wall or wall surface may provide a planar support structure.

The exercise equipment may comprise a cover, for example a blind or removable panel, such that it is hidden from view when not in use. The cover may be formed of a plurality of cover sections. The cover may comprise a plurality of adjacent cover sections. Each cover section may comprise a rigid board material and a softer cover material applied over at least one side of the rigid board material.

According to a further aspect of the invention, there is provided exercise apparatus comprising: a weight source operably connected to a plurality of manual actuators by a cable and pulley system comprising a plurality of pulley wheels, a supporting frame for the weight source and pulley wheels, and a cable defining a force path from the weight source over the pulley wheels wherein the pulley wheels and frame are provided in a common plane with the weight source at least when the exercise apparatus is not in use, the apparatus further comprising a cover arranged to lie flat against the frame in a storage condition, the cover being actuatable to a usage condition wherein the cover lies flat on a support surface by the frame in a usage condition so as to provide an exercise mat for a user.

Any optional features described in relation to any one aspect of the invention may be applied to any other aspect, wherever practicable.

Embodiments of the invention will be described in further detail below, by way of example only, with reference to the accompanying drawings of which:

FIG. 2 is a front view of the first support frame module of FIG. 1 with some further components in use;

Figure 1:
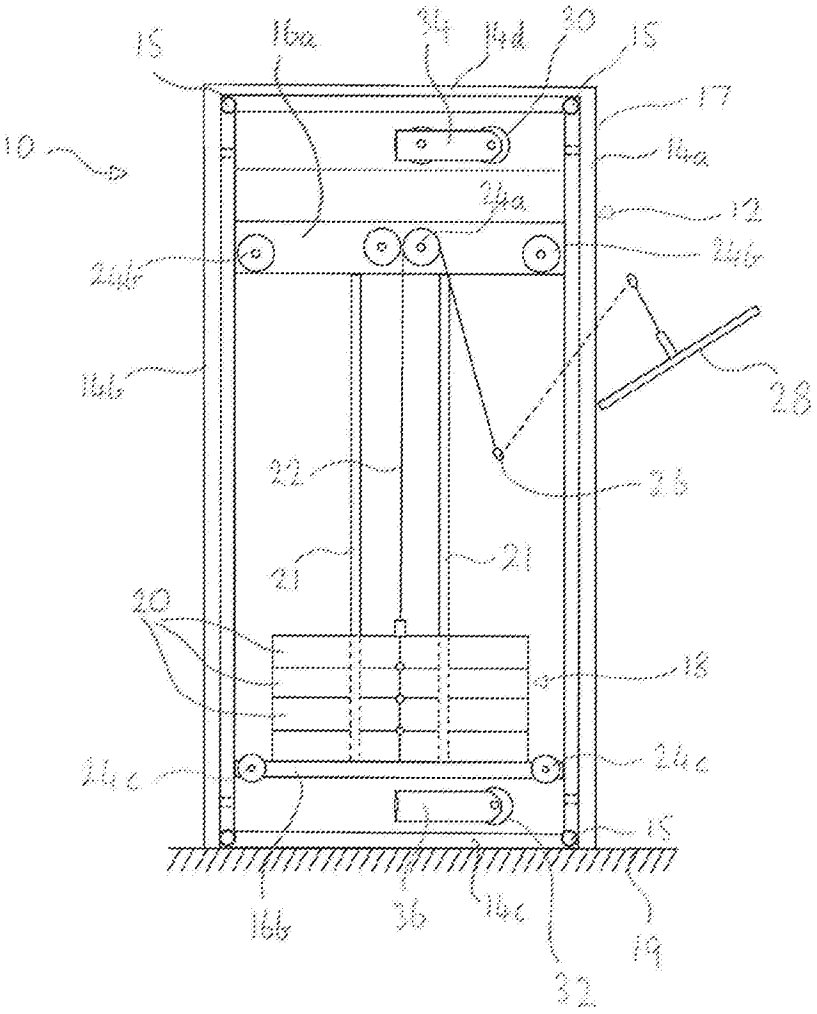
FIG. 1 is a front view of a first support frame module of exercise equipment according to an example of the invention.

Turning firstly to FIG. 1, there is shown an individual module 10 of a modular exercise equipment system. The module 10 comprises a generally rectangular outer support frame 12 comprising a series of elongate frame members 14, which may take the form of bars or narrow panels/leaves, and which are oriented so as to extend in the same plane. The frame members 14 comprise a pair of opposing upright members 14*a*, 14*b* and a pair of generally perpendicular frame members 14*c*, 14*d*. The upright pair 14*a*, 14*b* are generally parallel so as to define side walls of the support frame 12 and the horizontal pair 14*c*, 14*d* are generally parallel so as to define a base and upper member respectively.

The rectangular frame 12 defines a perimeter or outer wall of the module 10, i.e. such that the exercise equipment can be mounted within the module perimeter.

The frame is not self-supporting in this example and instead requires attachment to a suitable support structure. For this purpose, the frame 12 comprises fixing formations 15 mounted to the frame such that the frame can be attached to a suitable support using bolts or other conventional fasteners. In this example the frame is bolted to a wall such that the common plane of the frame is parallel with that of the wall. In this arrangement, the equipment lies flush against a wall and takes up minimal internal room space.

The frame may be attached to a wall at its four corners or at any suitable locations on the frame structure, typically at multiple locations about the perimeter of the frame and/or intermediate frame members. In some examples, the frame 10 may be located within a recess 17 in a wall, such as an alcove or else by removal of a section of an interior wall leaf, such that frame becomes embedded in the wall and does not protrude beyond the wall surface. Suitable brackets may be provided for mounting the frame to the wall or structural components within the wall such as wall studs, posts, beams or similar members. Fixings may be provided through the plane of the support frame or else laterally through the frame members as necessary.

In the example shown the lower frame member 14*c* rests on the floor 19 but could be elevated above the floor by one or more foot/pedestal if required.

The frame structure comprises a plurality of cross members 16*a* and 16*b*, which span the width of the frame structure between opposing upright frame members 14*a* and 14*b*. The cross members provide additional rigidity and mounting points for pulley wheels and/or cable guides as will be described herein. The cross members described are preferably planar or plate-like in form, i.e. in the form of panels, lying in the plane of the support frame. However the panel 16*b* supporting the weight stack may take the form of a beam or shelf.

The frame members disclosed herein may be formed of metal, such as steel, aluminium or similar and may be treated to provide a suitable surface finish, e.g. by a coating method, such as powder coating. The metal frame members are rigidly connected together, e.g. by welding, or else using another conventional fastening/fixing method. In other examples the frame members, particularly the outer frame members 14 could be formed of timber, of the frame could comprise a mix of timber and metal frame members.

The exercise equipment comprises a weight source 18 which is made up of a stack of individual weights 20, i.e. a so-called weight stack. The weight stack 18 may be conventional in form having a central opening, through which a selector pin member extends. The required weight to provide a desired resistance for a particular exercise may be selected by the user in a conventional manner by inserting a pin at the desired location in the selector member so as to include/exclude the desired number of weights from the weight stack in the force path connected to the cable. A pair of weight guides 21 pass through corresponding openings in the weights to maintain the alignments of the weights when stacked or lifted in use. The guides 21 are attached between the cross members 16*a* and 16*b*.

The weight stack 18 is generally centrally aligned within the frame, e.g. to allow positioning of exercise equipment on either side thereof, although this is not essential. Preferably the weight stack 18 is within the perimeter of the frame.

The weights 20 are bespoke to the present design, being of reduced depth dimension, the depth of the weights being sufficiently small that they do not protrude at all or to any significant extent beyond the depth of the frame 12. The depth of the weights and weight stack as a whole from front to back is preferably less than 150 mm or 120 mm and ideally of 100 mm or lower depth.

A cable 22 is attached to the weight stack at one end and extends around one or more pulley 24 part way along its length. In FIG. 1 a first length of cable is shown which terminates at a connector 26, such that one or more additional length of cable can be attached to the connector 16 to define varying cable lengths between the weight stack and the opposing end of the cable 22. The opposing end of the cable has a connector 26 for selective attachment of a manual actuator 28, which takes the form of a pull bar in this example. However the cable in FIG. 1 is not arranged for use and the varying cable length allows various cable and pulley circuits to be defined such that the exercise equipment is configurable to many different exercise types according to user preference.

Pulley wheels 24 are mounted to cross members 16 such that they are rotatable about an axis that is perpendicular to the plane of the cross member 16 and/or support fame 12. In the example shown, one or more central pulley 24*a* is arranged to receive the cable directly above the weight stack 18 and defines the first pulley in the cable and pulley system. A pair of first pulleys 24*a* are provided side by side on cross member 16*a* such that the cable could optionally pass over the left or right hand pulley initially according to different usage configurations.

A plurality of outer pulley wheel are mounted laterally of the central pulley(s) 24*a* towards/adjacent a respective side frame member 14*a*. Two outer pulley wheels 24*b* are mounted to cross member 16*a*, with one on each side of the central pulley wheel(s) 24*a*.

Two further outer pulley wheels 24*c* are mounted to lower cross member 16*b*, i.e. towards/adjacent frame members 14*a* and 14*b* and/or beneath pulley wheels 24*b*. The use of upper and lower outer pulley wheels permits a cable path which passes alongside respective upright frame members 24*b*, e.g. around or towards the frame perimeter. The cable path can thus pass around/beneath the weight stack in this example. The opposing upright cable portions within a single support frame module is beneficial in providing additional manual actuator locations for different exercises as shown in FIG. 2.

Additional pulley wheels 30 and 32 are provided at respective upper and lower sections of the frame 12. These pulley wheels 30 and 32 are intended to provide options for a final pulley wheel in the cable circuit, adjacent a free end of the cable 22 in certain usage configurations. The pulley wheels 30 and 32 are intended to be used in an orientation in which the pulley wheel is perpendicular to the plane of the support frame 12 and/or pulley wheels 24. The axis of rotation of pulley wheels 30, 32 in use may thus be parallel with the plane of the support frame.

In order to allow the pulley wheels 30 between storage and usage conditions, the wheels 30, 32 are mounted to respective hinged/pivoting brackets 34, 36, e.g. in the form of arms. The brackets 34, 36 are mounted to respective upper and lower cross members of the frame by a hinge but could otherwise be mounted to frame members 14*c*, 14*d* in other examples, e.g. by a pivot/pin mount. The brackets 34 and 36 can pivot between a storage condition in which the pulley wheels 30, 32 are aligned with the plane of the support frame and a usage condition in which the pulley wheels 30, 32 protrude outwardly from the frame for use.

The pulley wheel 30 provides for attachment of a pull-down bar (e.g. for a lat pull down exercise), whereas the pulley wheel 32 provides for attachment of a bar or other manual actuator intended to be pulled upwards in use (e.g. for a bicep curl exercise or similar). The provision of both pulleys 30 and 32 allows for multiple exercise options but either of those pulleys could be provided without the other in different examples of the invention.

It can be seen in FIG. 1 that the weight stack 18 is raised above the lower edge of the frame on cross member 16*b* so as to leave a lower region below the weight stack for mounting pulley 32, e.g. including pivoting bracket 36. This arrangement is advantageous in ensuring the minimal depth of the structure, whilst ensuring a full range of exercise options for the user.

In the storage condition, the operational members of the equipment are beneficially contained only within the frame perimeter but also within the frame depth. This allows the frame to provide a mounting surface to which a cover can be attached over part, or all, of the frontal area of the frame when the equipment is not in use. A cover of this kind is described in further detail below.

Turning now to FIG. 2, there is shown cable path and actuator options for use of the module 12. Although not shown in FIG. 1, there are provided formations on the upright frame members 14*a* and 14*b* for accommodating cable guiding members such as any or any combination of pulley wheels, guide blocks and/or rigid attachment points. The formations comprise openings in this example.

According to various examples of the invention, one or more openings may be provided along the length of either or both upright frame member 14*a* and 14*b* in order to receive a fastener. In the example of FIG. 2, a plurality of openings are shown comprising discrete openings 38*a* and 38*b* for mounting of a pulley wheel 40 and cable fixing point 42, such as an eye or hook formation. Such openings may receive a pin, bolt or similar fastener to hold the relevant cable and pulley system component relative to a fixed point on the frame.

FIG. 2 also shows a range-taking opening in the form of a slot 44 (shown in phantom) in each upright frame member 14*a* and 14*b*. The slot allows a further component 46 such as a cable guide or pulley to be attached at a desired location along the length of the corresponding frame member. Such a component 46 is height-adjustable to suit a given user or exercise. The component can be provided with a manual fastener 48 on the opposing side of the frame member for tightening/loosening the component, i.e. for selectively fixing or releasing/adjusting the position of the component along the frame member slot. A threaded bolt or similar releasable mechanism may be used to selectively fix/release the component 46.

In the configuration shown, the cable 22 passes upwards from the weight stack over the central pulley 24*a* followed by the outer pulley wheel 24*b*. The cable then passes downwards adjacent the inside edge of the upright frame member 14*b* and over left-hand pulley 24*c* such that it can pass beneath the weight stack to the other side of the module and over the other outer pulley wheel (i.e. right hand wheel 24*c*). From there the cable runs upwards so as to form a circuit around the weight stack 18.

From right-hand pulley 24*c*, the cable could pass over the adjustable pulley/guide 46 and terminate at a manual actuator in the form of handle 48. Thus a user could raise and lower weights 20 of the weight stack using the handle 48 at a height that is suited to the user's own height, or else a desired exercise type.

In another mode of use, the cable could pass up over the upper pulley 30 and a pulldown bar 28 could be attached at the free end of the cable. Alternatively, the cable could pass from upper pulley 30 around lower pulley 32 before terminating at a manual actuator.

Any of the features or cable system components shown on the right-hand side of the frame could additionally or alternatively be provided on the left hand side of the frame 12. Thus manual actuator 48 could be provided on either or both sides of the support frame. In order to permit flexibility in the system cable connectors (i.e. variable cable take-off points) are provided so that the length of the cable can be suitably adjusted by adding the required length of cable to the weightstack 18.

The module 10 is thus configurable for multiple different exercises and/or cable take-off points within a single frame. It is noted that the position of the pulley 40 or the pulley/guide 46 could be adjusted to permit different cable circuits as required by the user. The perpendicular orientation of the pulley 40 and/or pulley/guide 46 is therefore a beneficial feature of certain examples of the invention. Similarly the mounting of the pulley 40 and/or pulley/guide 46 to an upright frame member, e.g. using a suitable opening in the frame member may be beneficial (i.e. in addition to the pulleys 24 mounted to cross members).

As well as being useable as a single module of exercise equipment in its own right, the module 10 of FIGS. 1 and 2 may be attachable to one or more further module as will be described below to allow additional exercise options. For this purpose, the support frame 12 comprises a plurality of fixing formations 49 for attachment of a further module onto either or both upstanding frame member 14*a* or 14*b*. Such formation in this example comprise openings 49, which are align-able with corresponding openings in an adjacent frame module to allow a common fastener, such as a bolt to pass through the adjacent frame members. Thus two or more frame modules can be attached in a side-by-side arrangement with the adjacent upright frame members of each module held in an abutting relationship for use.

Figure 3:
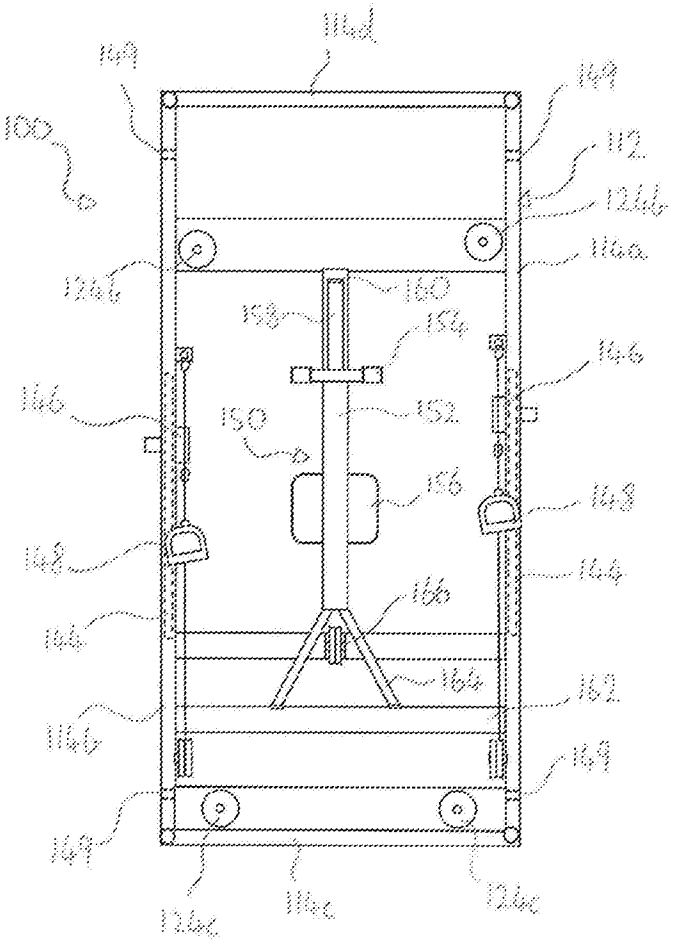
FIG. 3 is a front view of a second support frame module according to an example of the invention.

Turning now to FIG. 3, there is shown an example of a second module 100 comprising a second support frame 112. The second support frame is of construction that generally matches the first support frame 10 shown in FIGS. 1 and 2. Thus the peripheral frame members (including any openings therein), the cross members and pulley wheels are not described again for brevity. It is noted that any or any combination of such features may also apply to the second support frame and like numerals are used in FIG. 3, but with the prefix '1', where like features are shown.

A key difference between the second support frame 112 and the first support frame 12 is that the second support frame is not required to support a weight stack 18. Instead the second support frame can comprise an extension to the cable and pulley system of FIGS. 1 and 2, i.e. such that a common length of cable 22 can pass from the first to the second module so that the weight stack can be actuated selectively by manual actuators in either the first or second module.

In this regard it is generally not required to duplicate certain features such as upper and lower pulley wheels 30 and 32 from the first module. Similarly, it is not required to duplicate the central pulleys 24*a* of the first module in this example, although alternative pulley wheel positions can be implemented for other examples of second, or further, support frames as desired.

The absence of the weight stack in the centre of the second support frame 112 allows for the location of additional exercise equipment, whilst still retaining the desired depth profile of the overall frame structure.

In this example, the second frame module comprises a rowing machine 150. The rowing machine comprises a bar or bench 152 with feet 154 and a sliding seat 156 that may slide along the bench 152, e.g. along a runner therein. The seat may have rollers/casters on the underside thereof to permit motion of the seat along the bench.

When the exercise equipment is in a storage configuration, the rowing machine 150, e.g. the bench 152 and/or feet 154, may be folded upright such that it is stored flat within the frame. The feet 154 are mounted to a pivoting let 158 for this purpose. The leg is mounted to the underside of the bench at a hinge 160. In use, the rowing machine 150 may be folded out by lowering the upper end of the bench 152 such that the leg pivots downward and the feet 154 engage with the floor. A user may sit on the sliding seat 156, facing the frame 112 in a rowing position. The leg 158 may be freely-hingedly mounted to the bench and may fold down, e.g. such that it swings down under the action of gravity, as the bench 152 is lowered for use. The leg/feet could be manually actuated and/or locked in position for use as required.

It can be seen that the bench 152 is spaced from the hinged attachment with cross member 162 by arms 164. The arms 164 are spaced to provide a gap there-between such that a further pulley 166 can be located in the gap. The arms are oriented in a V-shape in this example.

The pulley 166 is for use with the rowing machine and is oriented perpendicular to the plane of the support frame in this example.

As with the first frame module of FIGS. 1 and 2, all components of the frame module 100 in FIG. 3 fit within the depth of the frame itself when stored. Thus a cover member can be applied to the frame, or immediately in front of the frame, to hide the equipment when not in use.

Figure 4:
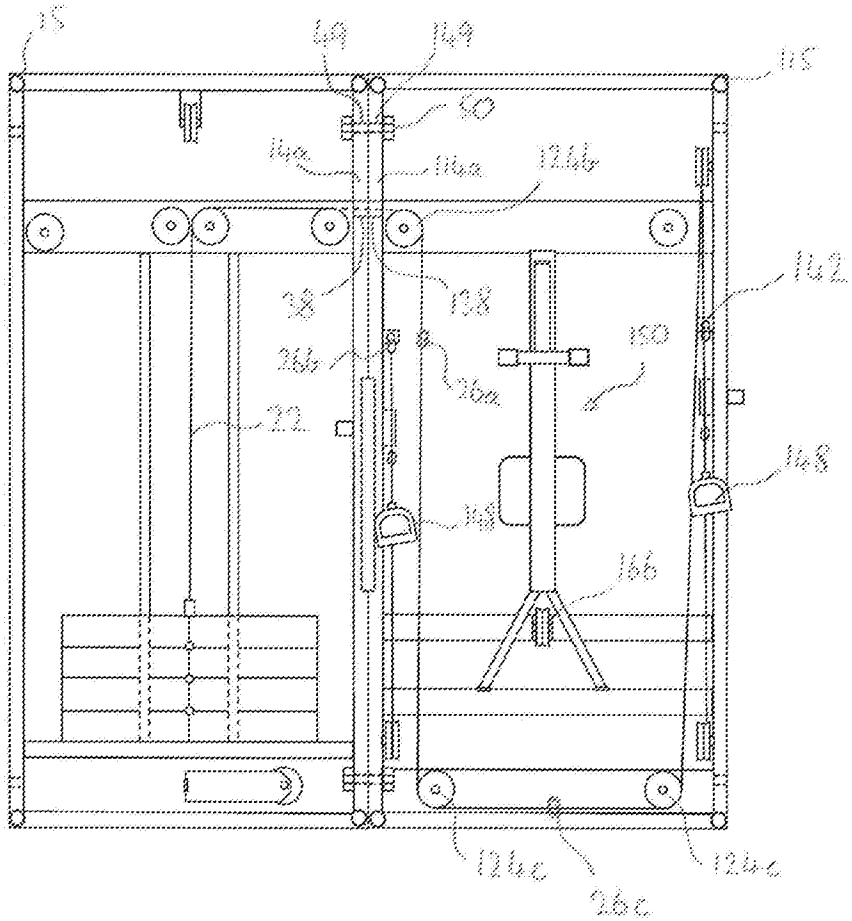
FIG. 4 shows a front view of the first and second support frame modules connected in a side-by-side arrangement in one possible exercise equipment configuration.

Turning now to FIG. 4, there is shown the first 10 and second 100 frame modules connected side by side such that the frame structures lie in a common plane. Bolts 50 pass through the common fixing openings 49, 149 on the adjacent frame members 14*a* and 114*a*, so as to provide a rigid frame system comprising the two frame modules 10 and 110 that can be commonly mounted to a support such as a wall, as described above. The rigid connection between the support frames 12, 112 means that it may not be necessary to attach all of the fixing formations 15 and 115 to the wall. For example, a subset of the of those fixing formations may be used, comprising a plurality of formations 15 of the first module and a plurality of formations 115 of the second module.

In use it can be seen that the cable 22 passes from the first module to the second module by a common opening 38/138 in each of the adjacent upright frame members 14*a* and 114*a*.

In this example, it can be seen that the cable 22 passes over pulleys 24*a* and 24*b* of the first module before passing over, in order, pulleys 124*b* and 124*c* of the second module. Thus the cable forms a similar path to that shown in FIG. 2 but this time around the second module, rather than the first module. The cable 22 thus passes around the rowing machine 150 and follows the direction of two or three adjacent frame members of the rectangular frame.

The manual actuators 148 are thus provided as part of the second frame module.

The cable 22 comprises a cable connector 26 acting as an optional connection point for a cable section 22*a* associated with the left hand manual actuator 148. Thus a connector 26 on the cable section 22*a* can be optionally connected to the connector 26 on the common cable 22 for use of the handle 148. A corresponding connector and optional cable section may be provided on the right hand side of the second module as shown in FIG. 4.

During use of the rowing machine 150, a cable connector 26*c* can be clipped around the cable 22 in-between the pulleys 124*c* this provides a slidable/moveable connection point for attachment of a rowing machine actuator, e.g. similar to the pullbar 28 shown in FIG. 1 such that a cable section associated with the actuator passes from connector 26*c* over pulley 166 for use. The actuator for the rowing machine 50 can thus act on a sliding connector on the main cable 22 between the two pulleys 124*c*.

The cable 22 in this example could terminate at a cable fixing point 142 on the frame or else could pass over right hand pulley 124*b* and pass back into the first module 10 to terminate at an alternative location.

Figure 5:
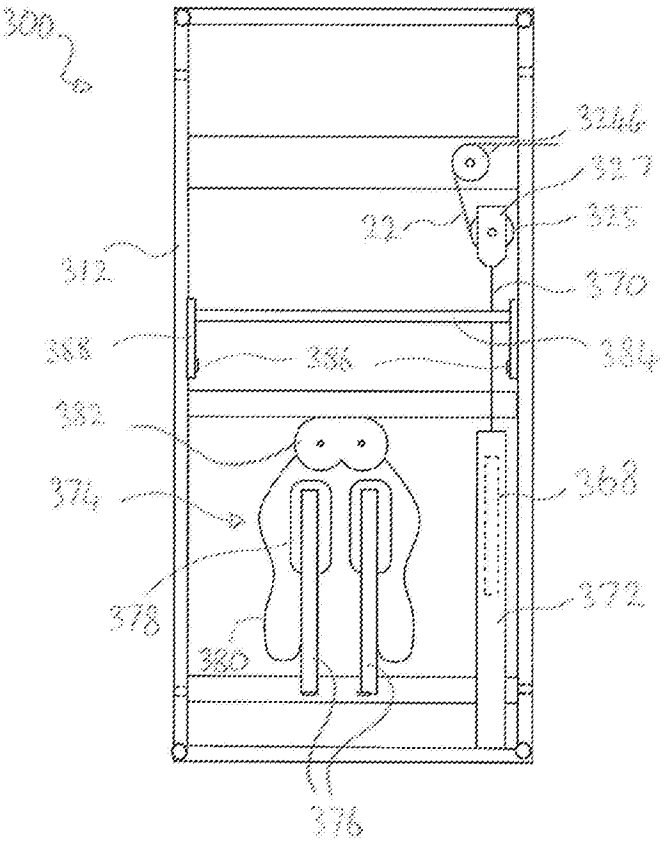
FIG. 5 shows a front view of a third support frame module of exercise equipment according to an example of the invention.

Turning now to FIG. 5, there is shown a third module 200 for optional use as part of a modular exercise system according to an example of the present invention. The third support frame is of construction that generally matches the first support frame 10 and/or second support frame 100. Thus the peripheral frame members (including any openings therein), the cross members and pulley wheels are not described again for brevity. It is noted that any or any combination of such features may also apply to the third support frame.

Whilst the third module 200 can be configured as a further extension to the common cable and pulley system in various examples of the invention, i.e. with manual actuators and/or cable sections of type similar to those of the first and/or second module, this example of the third module is used to show on potentially new/different features.

An example of a cable counter weight or tensioning system is shown in FIG. 5, which comprises at least one fixed pulley 324*b* and a floating pulley wheel 325 arranged to be suspended by the common cable 22 mid-way along its length. The floating pulley comprises a pulley housing 327 such that the pulley wheel 325 is rotatable relative to the housing on a pin/axle. The cable passes beneath the pulley wheel 325 in use.

A counter weight 368 is suspended from the pulley housing 327 by a cord 370. The counter weight 368 is held within a hollow guard or guide member 372 such that its motion is constrained, e.g. to generally vertical motion in use. The tension of the hanging mass 368 serves to dampen motion of the cable and to maintain correct positioning of the cable on the pulleys. Maintaining sufficient tension in the cable may help to prevent any twisting or looping in the cable and to prevent the cable becoming accidentally hooked onto parts of the equipment or dislodged from the pulley wheels. As an alternative to a counter weight, a spring or other elastic member could be used to maintain tension in the cable.

Figure 6:
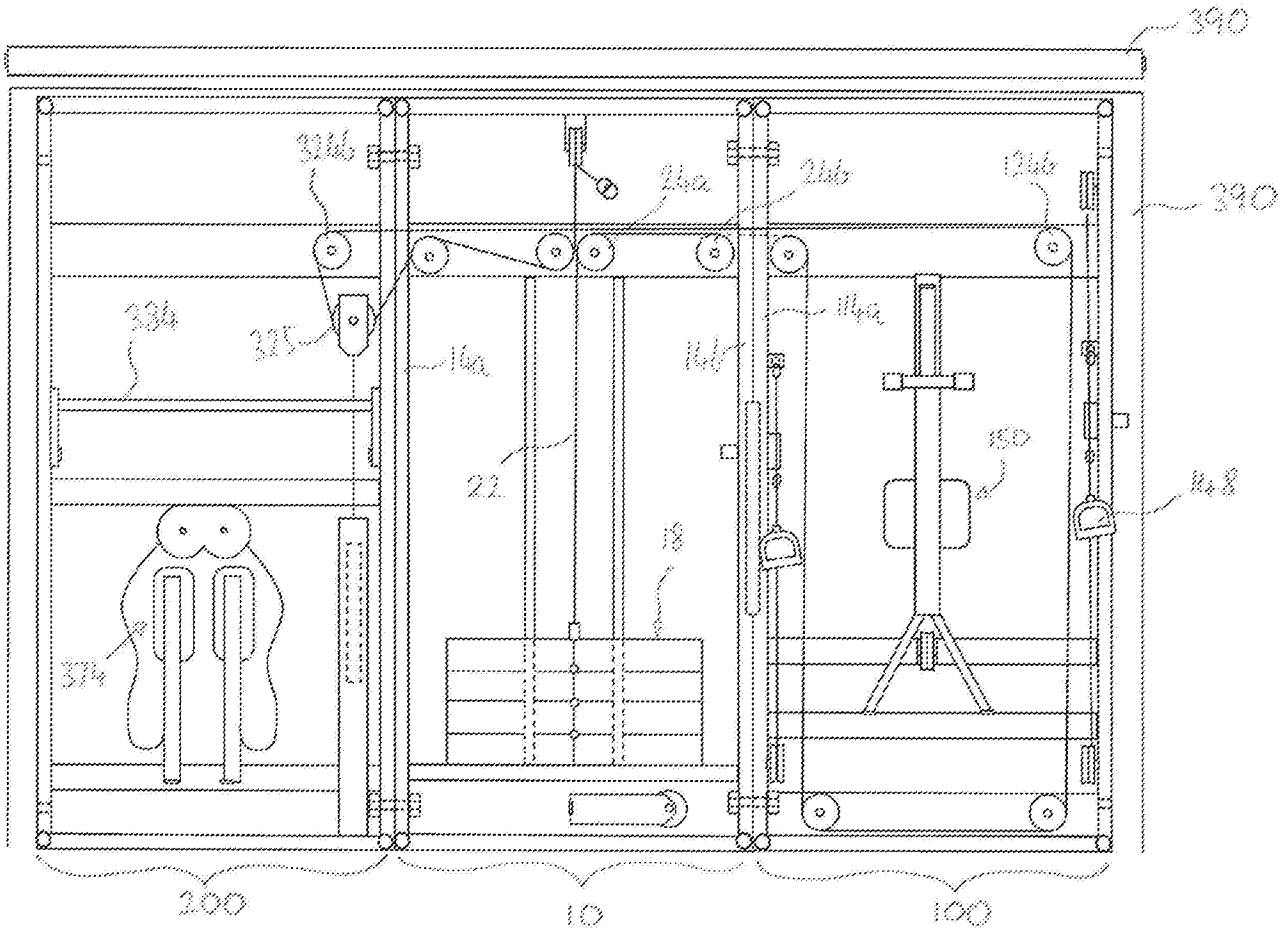
FIG. 6 shows a front view of first, second and support frame modules connected in a side-by-side arrangement in a third exercise equipment configuration, when in a storage condition.

Also shown in FIGS. 5 and 6 is the option of mounting additional gym equipment to a frame module, which does not require connection to the weight stack via the cable and pulley system. In this example a treadle system 374, e.g. a stepper, is connected to the support frame 312. The treadle system comprises a pair of lever arms 376 hingedly mounted to a cross member of the support frame at a horizontal spacing The arms 376 a pivotable about a horizontal axis such that the free end of each arm can raise and lower in a vertical direction.

Each arm has a foot plate 378 mounted thereon towards its free end. Between the foot plate and the connection to the frame, each arm 376 has a coupling 380 attached thereto. The coupling 380 takes the form of a chain in this example although a cord or cable could otherwise be used.

The chain passes from one arm through a resistance mechanism 382 to the other arm. The resistance mechanism comprises one or more wheel, in this example a pair of wheels, attached to a friction member/plate. The degree of friction between the wheel and plate can be adjusted by suitable mechanism, e.g. comprising a handle using a screw thread tightening arrangement, to alter the resistance to relative motion between the arms 376.

In the example shown, using a chain as the coupling 380, a toothed/gear wheel will be used in the resistance mechanism 382. During exercise a user will transfer force and relative motion between the foot plates 378 via the resistance mechanism 382. The lever arms 376 can pivot in use to allow stepper motion but can also pivot up into an upright configuration as shown in FIG. 5 to allow storage. The depth of the lever arms 376 is such that the stepper/treadle system can be maintained entirely within the depth of the frame 312 when stored.

The module 220 of FIGS. 5 and 6 also comprises a bar 384 attached to the opposing upright members of the frame 312 at pivot points 386. The bar is spaced form the pivot points by arms 388 at opposing ends thereof such that the bar can be raised and lowered between storage usage conditions. In the storage/upright condition, the bar 384 and arms 388 lie completely within the depth of the frame 312. One or more stops may be provided to hold the bar in its lowered condition for use, i.e. such that the arms 388 extend forwardly, out from the plane of the frame in use.

In this example the bar is generally at waist height for a user (i.e. approximately mid-way up the frame height) and provides a grip for a user when using the stepper 374. However in other examples, the bar 384 could be raised and lowered to permit other exercises. For example, a bar provided close to the base of the frame may be used as a grip for use when performing press-ups or else as a foot stop when performing sit-ups. A bar located higher on the frame could be used for chin-up exercises or similar.

Turning now to FIG. 6, the combined first 10, second 100 and third 200 modules are provided as a singular exercise system in a stored condition with each module being securely attached to the adjacent module in a side-by-side relationship. The upstanding frame members 14*a* and 14*b* of the first module 10 are in an abutting relationship with the adjacent upstanding frame member of each of the flanking modules 100, 200. Thus the first module and associated weight stack 18 is provided centrally in the system with the second and third module on opposing sides thereof. All support frames of the modules thus lie in a common plane so that the exercise equipment occupies a minimal depth dimension into a room.

In FIG. 6, it can be seen that the cable 22 passes up from the first weight stack and over the right hand central pulley 24*a* and right-hand outer pulley wheel 24*b* before passing through aligned openings in the frame members 14*b* and 114*a* so as to pass into the second module 100. The cable then passes around the second module 100 in the manner described above in relation to FIG. 3. In one example, the cable could terminate in the second module 100 but in this example, it passes over the right hand outer pulley wheel and through the first module (i.e. through openings in the relevant frame members) into the third module 200. The cable 22 passes over the pulleys 234*b* and 325 in the third module 200 before passing back into the first module 10, where the cable passes over the left hand central pulley 24*a* and up to the pulley 30.

This cable and pulley configuration can allow a significant variety of exercises to the user. The manual actuators in the second module 100 can be attached onto suitable connectors on the cable directly or can be attached by a branching cable as described above at a suitable take-off point. In the event that further exercise options are desired, it will be appreciated that additional pulley wheels could be added to either of the first 10 or third modules 200 to accommodate further options from the common weight stack 18. Alternatively, if the rowing machine 150 is not desired, it will be appreciated that the stepper 374 could be mounted in its place without connection to the cable system in either a two or three module system.

Using the system described above, various options for pulley placement are made available simply by providing optional pulley location points in the relevant frame members. Suitable pulley location points may comprise simple threaded holes/opening, to which pulleys can be affixed e.g. by the end user. The modular units may be manufactured to a common design with various options for cable-and-pulley configurations available to the end user by providing predetermined pulley location points. Alternatively each system may be customised for a particular setup by applying only pulley location points at the specified pulley location points for that system.

Whilst the arrangements of FIGS. 4-6 show specific pulley wheel arrangements, it will be appreciated that any of the pulley and/or cable guide locations of FIG. 1 or 3 could be applied to any of the first 10, second 100 and/or third 200 modules if desired.

Also shown in FIG. 6, is an optional roller blind or rolling screen 390, such that the blind can be lowered to conceal the exercise system when stored. It is generally preferred to allow the equipment to be exposed in use so that a user can alter the cable/pulley circuit as desired. However in other examples, the entire system could be maintained behind a more rigid covering, such as a board, panel or the like, with openings at predetermined locations to expose only the specific regions in which user access is required. Thus the moving cable and pulleys could be generally concealed in use if required. In examples of the invention wherein the exercise equipment is mounted inside a wall cavity, there may be provided openings in the wall surface through which actuators may depend from the pulley system. Alternatively, openings may be provided in a panel that covers the exercise equipment, through which actuators may be attached to the pulley system. In another embodiment, which is in many ways preferred, the entire system is provided with a removable/actuatable cover member, which may serve as an exercise mat when the equipment is in use.

Figure 7:
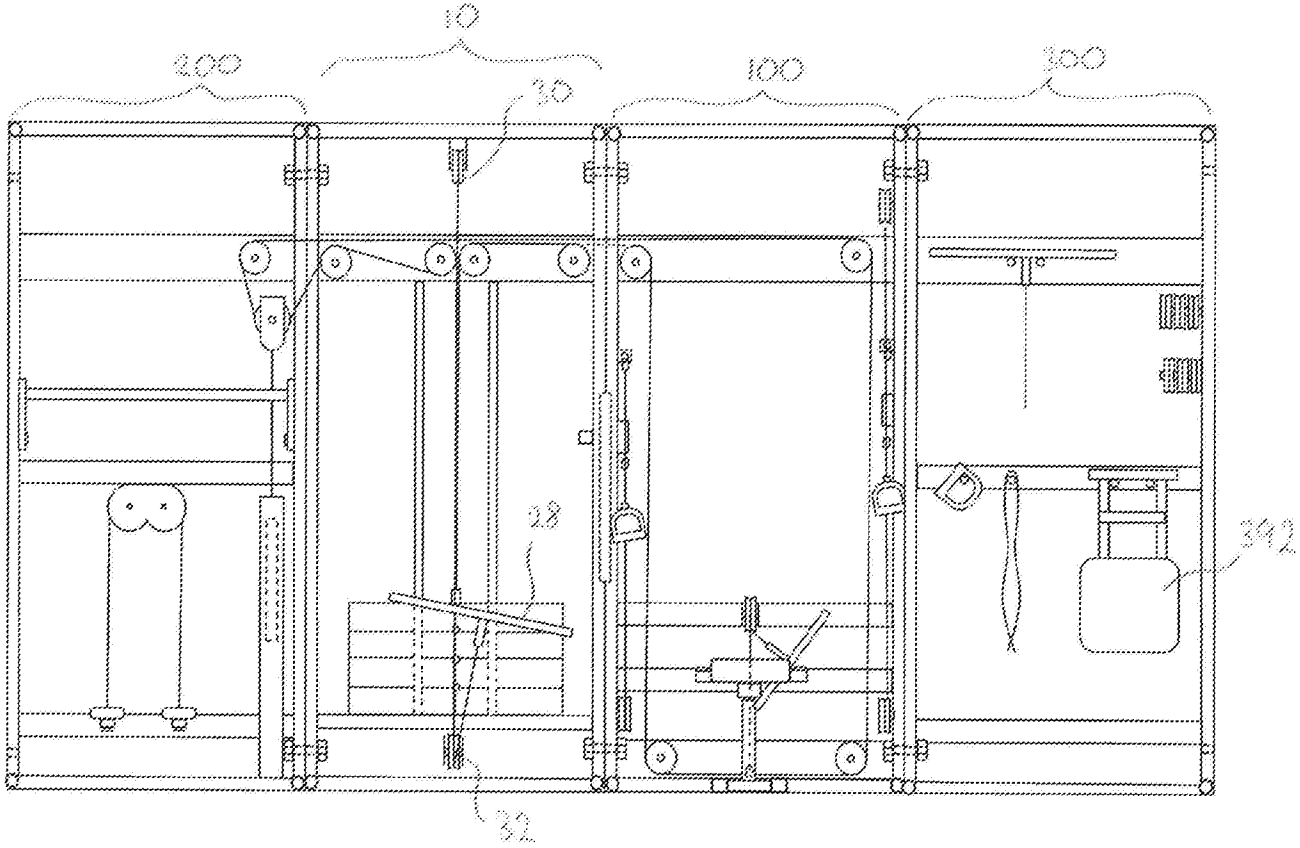
FIG. 7 shows the exercise equipment of FIG. 6 in a usage condition with an optional fourth support frame module; and, FIG. 8 shows a front view of a further example of the present invention with a cover.

Turning to FIG. 7, there is shown an example of the system in use with the frame modules exposed and the cable passing from the upper pulley 30 in the first module over the lower pulley wheel 32 before terminating at a connection to the pull bar 28.

FIG. 7 shows an optional additional module 300 intended for equipment storage. Thus the module 300 comprises any or any combination of hangers, hooks, pins, or the like mounted to the frame members, such as the upright and/or cross members of the support frame. The additional module 300 may allow storage of any of the manual actuators, spare pulley wheels, cable clips and/or cable sections described herein. In this example, there is also shown a collapsible stool/seat 392, which may be stored in collapsed form so as to fit within the desired depth profile of the frame system.

Whilst the arrangements of FIGS. 4, 6 and 7 show a specific order/arrangement of modules, it will be appreciated that the first and third module could be used together, e.g. in absence of the second module, or else that the relative position of the second, third and/or fourth module on either side of the first module could be changed if desired. Thus the modular system is fully customisable to individual requirements. Certain accessory storage features could be provided in any of the first, second and/or third modules subject to space constraints, if a dedicated storage module 300 is not desired.

Within the various configurations of the invention, the various pulley wheels are typically oriented in the common plane of the support frame, with the possible exception of the final pulley wheel preceding a manual actuator connection to the cable, for which the pulley wheel may be generally perpendicular to the pulley wheels in the common plane.

The cable connectors described herein may comprise any or any combination of an eye, loop, hook or a releasable connector such as a carabiner connector or similar.

Additional cable guides could be provided on the support frame of any module of the equipment at locations according to the positions of the manual actuators and/or pulley wheels. Such guides could serve to constrain the motion of the cable where necessary, e.g. to prevent unwanted cable displacement during exercise.

It has been found that the support frame and exercise system is sufficiently thin as to lend itself to mounting within a wall, i.e. between embedded within a surface of a wall structure. Thus according to various aspects of the invention, the exercise system is characterised by its reduced depth such that it is not self-supporting and requires fixing to a suitable support structure such as the wall of a building.

Figure 8:
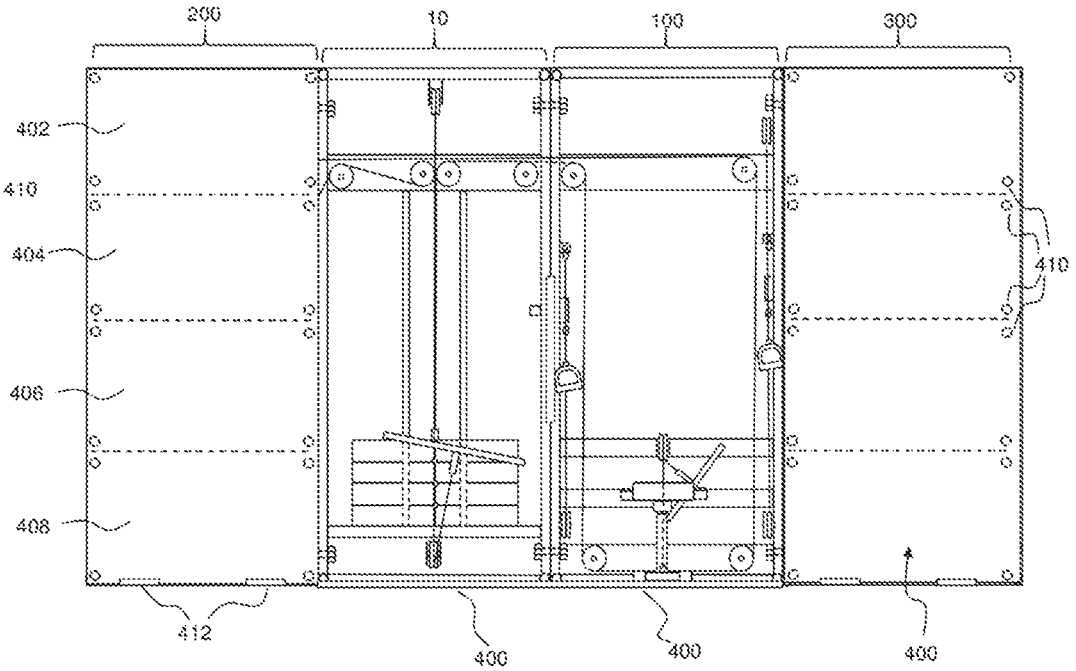

Turning to FIG. 8, there is shown a cover system that may be applied to any individual frame module, or combination of frame modules, as desired. In this example, each frame module 10, 100, 200, 300 has associated therewith a cover 400. The cover 400 may be a flexible sheet/mat material, such as a foam, polymer or textile material. However in this example, the cover comprises a rigid board material. The board may be formed of wood, fibreboard, composite, cardboard or similar material. In this example, the board has a softer cover material, e.g. a foam, polymer/elastomer or textile, over at least one face of the board.

The cover 400 for each frame module is formed in a plurality of sections 402-408, e.g. joined by the softer cover material, which allows each section to pivot/fold relative to the adjacent section when not attached to the frame.

Each cover is attached flat against the frame in the storage condition using a releasable attachment means. In this example, magnets 410 are embedded in the cover, which are spaced so as to align with the upright and/or horizontal frame members. The cover can be held magnetically on the metal frame members, or on metal/magnetic inserts on the frame members in the event that a timber or non-ferromagnetic frame is used. Rare earth magnets may be used if necessary to hold the cover in place.

As shown in FIG. 8, the individual cover sections may each have magnets/fasteners thereon so they can individually attach to the frame if required. If magnets are not used, other releasable fastenings could be used, such as clips, poppers or hook and eye/loop fasteners.

Also shown in FIG. 8 is an additional attachment between the lower edge of the cover 400 and the lower/base portion of the frame. in this example a permanent hinged attachment 412 is used such that the cover can pivot relative to the frame module to which it is attached. The cover can be lowered to floor when the frame module is being used. In other examples, the cover may simply clip onto, or magnetically attach to the lower region of the frame when the frame module is in use.

As can be seen in FIG. 8, the cover for individual frame modules can be lowered for use as desired. When lowered, the cover lies flat on the floor in from the respective frame module and serves as an exercise mat. This provides a safe exercise surface for standing exercises but can also provide cushioning for floor exercises as desired. The cable system through each frame modules can beneficially operate even when the relevant frame module is covered. Thus a user only needs to lower the cover for a given exercise. In other example, instead of individual cover sections for each module, a single cover for the entire frame system could be provided.

When individual cover sections are used, the sections lie immediately adjacent on the floor, when serving as an exercise mat. Thus a substantially continuous exercise mat is provided. In some embodiments, adjacent sections could be provided with mating formations, e.g. tabs and recesses or similar, to ensure correct alignment.

Whilst mounting of the system in the interior of a building, i.e. an internal room is envisaged as being more common, it will also be appreciated that the frame and exercise equipment could be mounted on an exterior supporting structure or wall if preferred. If mounted on the exterior surface of a building, the cover may protect the apparatus from the elements.

In other examples of the invention, the rigid frame structure of the invention could be mounted to other planar support structures which may be static or moveable between different modes of operation. For example the frame could be mounted in a generally horizontal condition to the underside of a bed or the like, which could be elevated/raised to an upright configuration in the event that it is desired to use the gym equipment. A lock latch would thus be required to maintain the support structure in an upright configuration when exercising.

The invention may allow different configurations of exercise equipment offering different exercise options to be installed in rooms with varying available wall space, and without occupying a detrimental volume of the room, e.g. allowing the room to provide an additional function other than being purely used as an exercise room.

What is claimed is:

1. A modular exercise system comprising:

a first support frame module having a plurality of frame members comprising a pair of upright frame members defining opposing lateral sides of the first support frame module, each upright frame member being joined to an adjacent frame member and oriented in a common plane;

a weight source mounted on the first support frame module;

a plurality of pulleys mounted to different frame members of the first support frame module;

a cable running from the weight source over the plurality of pulleys to connect the weight source to a plurality of manual actuators for performing a resistance exercise in use, the weight source and the plurality of pulleys being located between the pair of upright frame members;

the first support frame module comprising one or more fixings configured to hold the modular exercise system in an upright orientation to a wall for use; and a further support frame module also being two-dimensional in form and having one or more attachment formations such that the further support frame module is configured to be attachable to the first support frame module and/or the wall in an orientation within the common plane, wherein the further support frame module comprises one or more further manual actuators;

wherein at least one of the pair of upright frame members of the first support frame module comprises a cable opening to allow the cable to pass through at least one of the pair of upright frame members from the first support frame module to the further support frame module;

wherein the plurality of manual actuators are provided within the first support frame module, such that the first support frame module is configurable as a single standalone piece of exercise equipment, offering a plurality of manual actuator configurations based on the cable and the plurality of pulleys within the first support frame module alone and the further support frame module is configured to be selectively useable to offer one or more further exercise options for a user by the cable passing from the weight source of the first support frame module through said cable opening to the further support frame module.

2. The modular exercise system of claim 1, wherein the further support frame module comprises a second support frame module and a third support frame module, each attachable to the first support frame in an orientation within the common plane.

3. The modular exercise system of claim 2, wherein the second and third support frame modules are attachable on opposing lateral sides of the first support frame.

4. The modular exercise system of claim 1, wherein the further support frame module comprises a plurality of further pulleys and the cable passes around the plurality of pulleys of the first support frame module and the plurality of further pulleys of the further support frame modules so as to define a common cable circuit between the first and further support frame modules and, wherein the cable follows a path over at least a first pulley of the first support frame module, followed by one or more further pulleys of the plurality of further pulleys of the further support frame module and subsequently a second pulley of the first support frame module.

5. The modular exercise system of claim 4, wherein the support frame modules comprises second and third support frame modules and the cable passes from the first support frame module over further pulleys of the plurality of further pulleys of the second and third support frame modules.

6. The modular exercise system of claim 1, wherein the one or more further manual actuators of the further support frame module is connected to the weight source of the first support frame module by the cable.

7. The modular exercise apparatus of claim 6, wherein the further support frame module comprises a rowing machine and the one or more further manual actuator comprises a pull bar for the rowing machine.

8. The modular exercise system of claim 1, wherein the first or further frame modules comprises a bench or a seat mounted thereto, the bench or the seat being pivotably mounted such that the bench or the seat can pivot between a storage condition in which the bench or the seat is aligned with a plane of the first or further support frame modules and a usage condition in which the bench or the seat is angularly oriented relative to said plane.

9. The modular exercise system of claim 8, wherein angularly oriented relative to said plane is perpendicular.

10. The modular exercise system of claim 1, wherein the first support frame module further comprises one or more attachment formations for attaching one of the upright frame members of the first support frame module to an adjacent upright frame member of the further support frame module.

11. The modular exercise system of claim 1, wherein either or both of the first and further support frame modules comprises at least four pulley wheels located towards opposing lateral sides of said support frame module so as to define a cable path that extends in a direction of said opposing lateral sides, thereby passing around the weight source or an article of exercise equipment located towards a center of said support frame module and, wherein the first and/or further support frame module is rectangular in form and the cable follows a path along at least three sides of the first and/or further support frame module.

12. The modular exercise system of claim 1, wherein the weight source is supported at a height spaced from a base of the first support frame module, the first support frame module comprising at least one pulley located beneath the weight source, and wherein the at least one pulley beneath the weight source is mounted to the first support frame module by a pivoting bracket such that said at least one pulley can pivot between storage and usage orientations.

13. The modular exercise system of claim 1, wherein the modular exercise system including the first and further support frame modules has a depth dimension of less than 200 mm or 150 mm.

14. The modular exercise system of claim 1, wherein an upright frame member of the first support frame module comprises an elongate opening for selective positioning of one of the plurality of a further pulleys or a cable guide at a selected location along a slot.

15. The modular exercise system of claim 1, comprising a cover for the first and/or further support frame modules, wherein the cover extends over a frontal surface of the first and/or further support frame modules in a storage condition and is releasable from the first and/or further support frame modules so as to lie flat on a support surface in front of the first and/or further support frame modules in a usage condition, such that the cover provides an exercise mat in use.

* * * * *